United States Patent [19]

Ferris et al.

[11] Patent Number: 4,805,539

[45] Date of Patent: Feb. 21, 1989

[54] WELL CAR END STRUCTURE HAVING FRAMELESS RADIAL TRUCK

[75] Inventors: Ray L. Ferris, Thornton, Ill.; Phillip G. Przybylinski, Schererville, Ind.

[73] Assignee: Trinity Industries, Inc., Dallas, Tex.

[21] Appl. No.: 47,980

[22] Filed: May 7, 1987

[51] Int. Cl.[4] ..... B61F 1/10

[52] U.S. Cl. ..... 105/355; 105/158.2; 105/211; 105/404

[58] Field of Search ..... 105/158.1, 158.2, 165, 105/211, 212, 213, 355, 404, 411, 414

[56] References Cited

U.S. PATENT DOCUMENTS

| | | | |
|---|---|---|---|
| 560,155 | 5/1896 | Curtis | 105/213 |
| 805,105 | 11/1905 | Timmis . | |
| 912,440 | 2/1909 | Becker | 105/417 |
| 1,730,035 | 10/1929 | Gregg | 105/211 |
| 1,948,259 | 2/1934 | Driemever . | |
| 2,091,360 | 8/1937 | Hedgcock | 105/414 |
| 2,680,413 | 6/1954 | Becker . | |
| 2,706,453 | 4/1955 | Schneider . | |
| 2,841,096 | 7/1958 | Hirst . | |
| 2,841,097 | 7/1958 | Travilla . | |
| 2,954,747 | 10/1960 | Hirst et al. . | |
| 3,067,698 | 12/1962 | Lee et al. | 105/211 X |
| 4,475,463 | 10/1984 | Tilly et al. | 105/208 |
| 4,478,155 | 10/1984 | Cena et al. | 105/355 |

FOREIGN PATENT DOCUMENTS 2030277 6/1970 Fed. Rep. of Germany .

*Primary Examiner*—Stephen Hepperle

*Attorney, Agent, or Firm*—Myers & Ehrlich, Ltd.; John J. Kowalik

[57] ABSTRACT

A railway well car for the transport of containers has a depressed floor section supported between lateral side structures and longitudinal end structures. Each end structure is supported on a frameless radial truck. The frameless radial truck has four longitudinally spaced resilient support elements on each lateral side thereof. The end structure has a reinforcement structure for transferring loads from the car body to the support elements. The reinforcement structure includes a pair of transverse beams extending from a stub center sill to respective side structures. Longitudinal beams extend from the transverse beams to an end sill structure and to a girder structure at the end of the well portion of the car. Each longitudinal beam supports a pair of box structure truck engagement means engaging the resilient support elements. The transverse beams and the longitudinal beams are comprised of channel members attached to the undersurface of a shear plate forming tubular torque box structures therewith. At the end of the well portion diagonally extending support members and tapered plates efficiently beam loads in the side structures to the reinforcement structure and to the truck.

19 Claims, 3 Drawing Sheets

WELL CAR END STRUCTURE HAVING FRAMELESS RADIAL TRUCK

BACKGROUND OF THE INVENTION

1. Related Applications

This application is related to the U.S. patent application having Ser. No. 047,982, filed May 7, 1987, and entitled "OFFSET SIDE BEARING STRUCTURE FOR WELL CAR" by inventors Donald B. Yates and Eugene R. Tylisz, and the U.S. patent application having Ser. No. 047,981, filed May 7, 1987, and entitled "WELL CAR END GIRDER ARRANGEMENT" by inventors Bradford Johnstone, Phillip G. Przybylinski, and Eugene R. Tylisz.

2. Field of the Invention

This invention relates to the end structure of a railway car, and more particularly to an end structure designed to be supported on a frameless radial truck.

DESCRIPTION OF THE PRIOR ART

The usual practice in prior art has been to support a railway car body with a four-wheeled truck at each end of the car. The truck normally comprised a frame supporting two axles each having two wheels. A pin at approximately the center of the truck extended upwardly, and the car body had a reinforced receiving opening which admitted the truck pivot pin for support of the car body on the truck. The structure of the car body was designed to transmit almost all of the vertical load of the weight of the car body and cargo to the truck at one particular point, i.e., the structure around the truck pivot pin.

Recently, frameless radial trucks have been devised which do not have a frame restricting movement of the axles, but include a pair of axles with wheels thereon supporting four castings. Each casting supports a pair of resilient connection structures in the area of the wheels. The resilient structures supportingly engage the car body. The engagement results in vertical loads being transferred in a number of different locations in the car body spaced from the central location usual in the prior art. The car bodies configured for use with frame trucks having a central pivot pin are ill-equipped to support loads in these locations.

SUMMARY OF THE INVENTION

A railway car is provided with a truck which includes a transversely extending axle and pair of wheels to rollingly support the truck on a pair of rails. The truck has first and second transversely spaced pairs of longitudinally spaced support means for receiving vertical loads. The end structure of a car body is supported on the truck on these support means. The end structure includes first and second longitudinally extending side sill members spaced transversely of each other. A center sill extends generally longitudinally between the side sill members. A first beam member is fixedly connected with each of the side sill members and extends transversely therebetween. First and second cross support members are positioned longitudinally inwardly of the first transversely extending beam member. Each is fixedly connected with the center sill and with a respective side sill member. First and second truck support members are each fixedly connected with the first beam member and with a respective cross support member. The truck support members each have a pair of longitudinally spaced truck engagement means engaging a respective pair of support means on the truck for supporting the car body on the truck. The cross support members and the transversely extending beam member receive vertical loads from the side sill members and transfer the loads to the associated truck support beams for supporting the end structure of the car on the truck. One of each pair of truck engagement means is adjacent the transversely extending beam member, and the other of each pair of truck engagement means is supported adjacent the associated cross support member to efficiently transfer the vertical loads received from the beam member and cross support members to support means of the truck to support the end structure of the car thereon.

DETAILED DESCRIPTION OF THE DISCLOSURE

Figure 1:
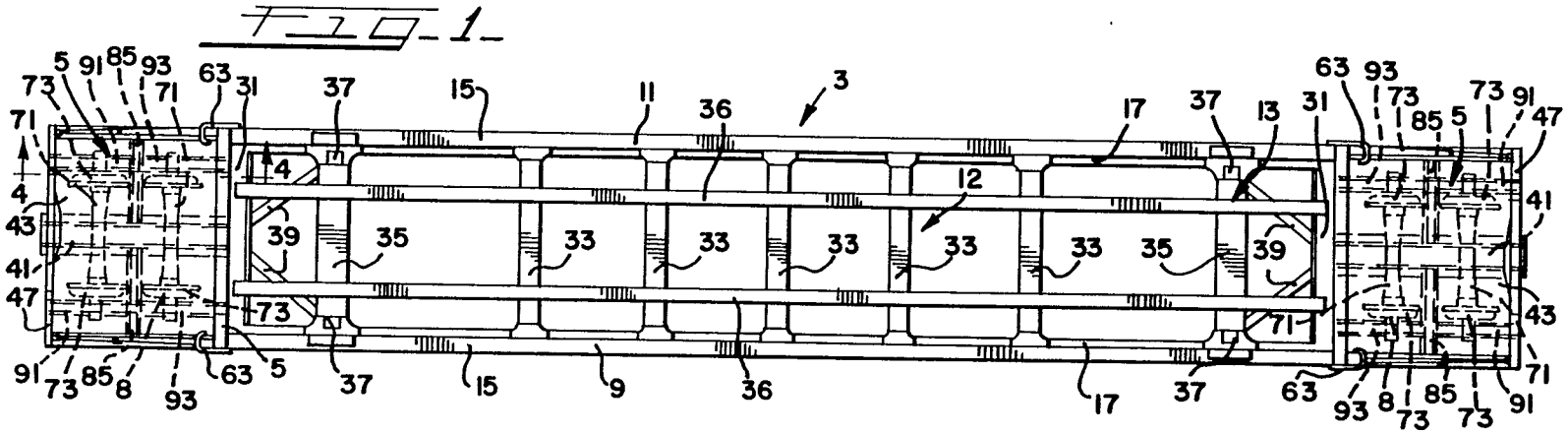
FIG. 1 is a plan view of the railway car of this invention.
Figure 2:
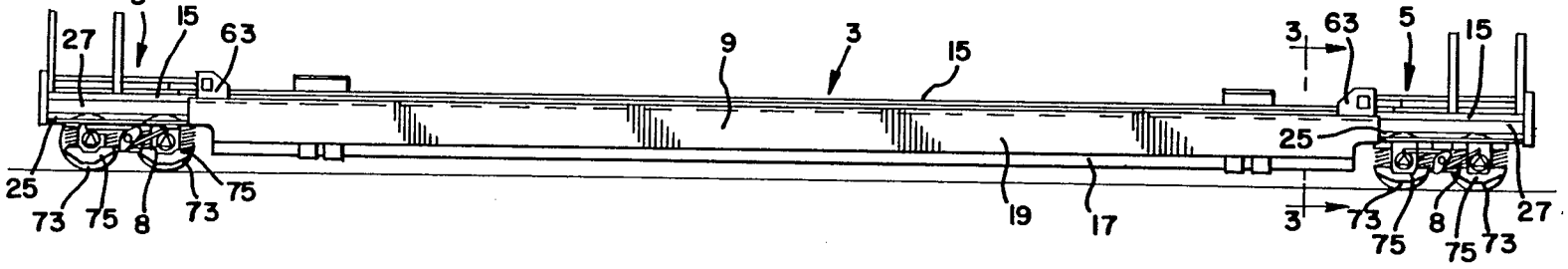
FIG. 2 is an elevational view of the railway car shown in FIG. 1.

As best shown in FIGS. 1 and 2, a railway car 3 has two opposing end structures generally indicated at 5, and an intermediate portion generally indicated at 7. Each of the end structures 5 is supported on a respective truck 8 for rolling movement of the car 3 on the rails.

The intermediate portion 7 includes a pair of laterally spaced longitudinally extending side structures 9 and 11 supported at opposite sides of the car and extending substantially the length of the car 3 adjacent the lateral sides of the end structures 5. The side structures 9 and 11 define a depressed cargo carrying space therebetween generally indicated at 12 for receiving cargo containers. Cargo containers placed in this cargo carrying space are supported by a floor structure indicated at 13 which is supported between the side structures 9 and 11 at a level approximately 10½ inches above the rails.

Figure 3:
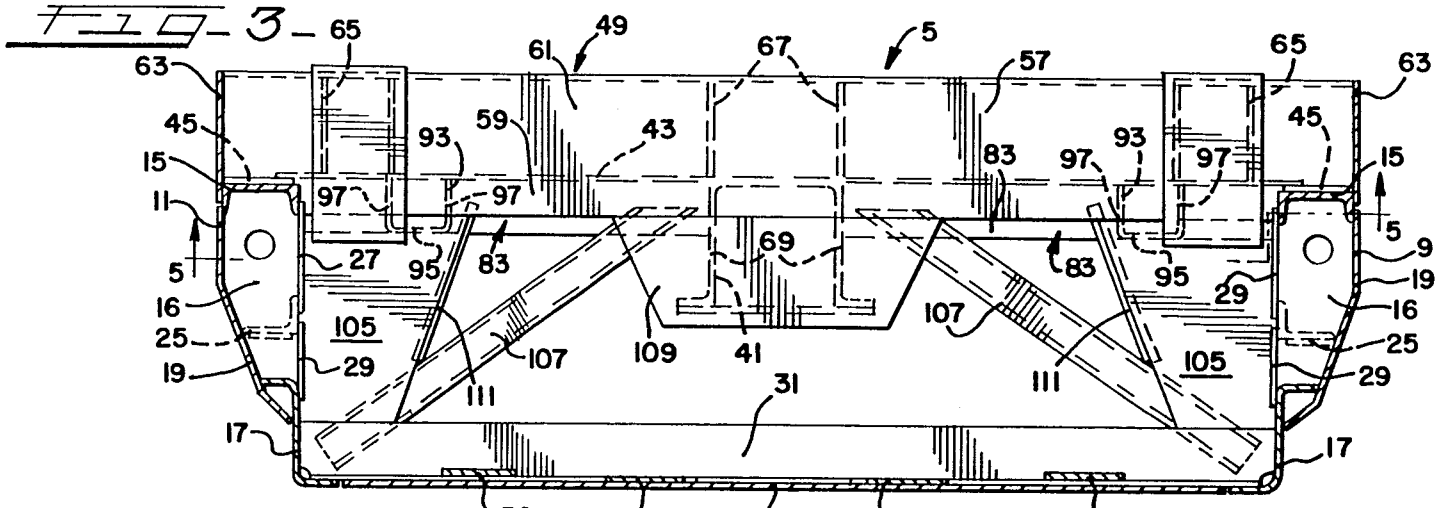
FIG. 3 is a view taken along line 3—3 of FIG. 2 showing the girder structure supporting the floor structure of the railway car.

As best shown in FIG. 3 the side structures 9 and 11 each include a channel shaped member 15. Beam structures 16 depend downwardly from channel member 15 and are connected to z-shaped floor support member 17. Outer cover plate 19 is secured to a laterally outward portion of the channel member 15, beam structures 16 and floor support member 17.

Adjacent the end structures 5 of the car 3 the side structures 9 and 11 are provided with an angled-shaped member 25 connected with the upper channel member 15 by a laterally inward positioned wall portion 27.

Angle shaped member 25 and wall portion 27 extend below channel member 15 from a location longitudinally inward from the end of the intermediate portion 7 to the ends of the car 3. A second wall portion 29 connects the angle member 25 to the floor support member 17 at the lower ends of side structures 9 and 11.

The floor structure 13 includes a pair of transversely extending end members 31 at the end of the floor structure 13 adjacent respective end structures 5 and a plurality of transversely extending cross support members 33 extending transversely between the floor support members 19 of side structures 9 and 11 to form the floor structure 13. Cross members 35 extend between the floor support members adjacent the longitudinal ends of the floor structure 13. Longitudinal floor members 36 are connected to each of the end members 31 and the cross members 33 and 35 and extend from end member 31 to opposite end member 31 over the full length of floor structure 13.

Cross members 35 each have container engagement means 37 thereon for securingly engaging a container placed in the depressed cargo carrying space. The container engagement means 37 secure the container to the floor structure 13 and receive various loads from the container placed thereon resulting from movement of the car 3. The loads in the well portion of the car 3 are created primarily by the weight of the containers resting on the floor structure 13. The vertical loads applied at the support means 37 are transmitted through the cross members or 35 to the floor support members 17 of side structures 9 and 11. Longitudinal and lateral loads in the container engaging means 37 are transmitted to the side structures 9 and 11 and also through obliquely extending support members 39. Support members 39 are connected with the cross members 35 adjacent the container engagement means 37 and extend longitudinally outwardly and laterally inwardly therefrom to be fixedly secured to a middle portion of end member 31. Support members 39 form an integrated truss structure with the associated cross members 35, members 31, and floor support members 17 for supporting a variety of loads applied at container engagement means 37.

As is best visible in FIGS. 1 and 3, each end structure 5 includes a center sill 41 which extends longitudinally of the car. Center sill 41 receives coupler means (not shown) therein for connection to adjacent railway cars. Shear plate member 43 is attached to the upper surface of center sill 41 and extends generally horizontally thereabove between the side structures 9 and 11. The lateral sides of shear plate member 43 are attached to connection plates 45 which are secured on top of the channel members 15 of each of the side structures 9 and 11. As a result, longitudinal buff and draft loads applied to the stub center sill 41 are transferred to the shear plate member 43 and beamed laterally outwardly to the side structures 9 and 11 which transmit these buff and draft loads over the length of the well portion of the car 3 to the opposite end structure 5 and into the center sill 41 thereof.

Shear plate member 43 extends longitudinally of the car 3 from a transversely extending beam or end sill structure 47 at the longitudinal end of the car to the girder structure generally indicated at 49 which extends transversely above the side structures 9 and 11 adjacent the end of the well portion of the car. End sill structure 47 is a deep channel beam comprising a vertical wall 51 and generally horizontally extending top and bottom flange portions 53 and 55. Shear plate member 43 is fixedly connected as by welding to vertical wall 51 of end sill structure 47.

Girder 49 comprises a deflection member 57 which extends transversely of the car 3. Deflection member 57 includes a vertical wall portion 59 fixedly attached as by welding to the inward terminal edge of the shear plate member 43. Deflection member 57 also includes a slope portion 61 extending upwardly and angularly outwardly from vertical portion 59. Slope portion 61 is provided to form a deflecting surface for guiding containers lowered onto the car 3 into the well portion. Deflection member 57 extends between lifting lugs 63 which are supported at each lateral side of the car 3. Lifting lugs 63 strengthen deflection member 57 for receiving impacts from containers. Deflection member 57 is also reinforced by channel-shaped reinforcement members 65 supported between the shear plate member 43 and deflection portion 61 of deflection member 57. Deflection member 57 is also reinforced by gussets 67 connected to the upper surface of shear plate member 43 and the lower surface of deflection portion 61. Gussets 67 are also vertically aligned with the vertical walls 69 of the stub sill 41 for sound structural support of the gussets 67 and the connected deflection member 57. Deflection portion 57 forms with the shear plate member 43 a generally transversely extending roughly channel-shaped girder structure 49 which supports vertical loads in the side structures 9 and 11 and transfers them laterally inward in the end structure 5 to be supported on the associated truck 8.

Figure 4:
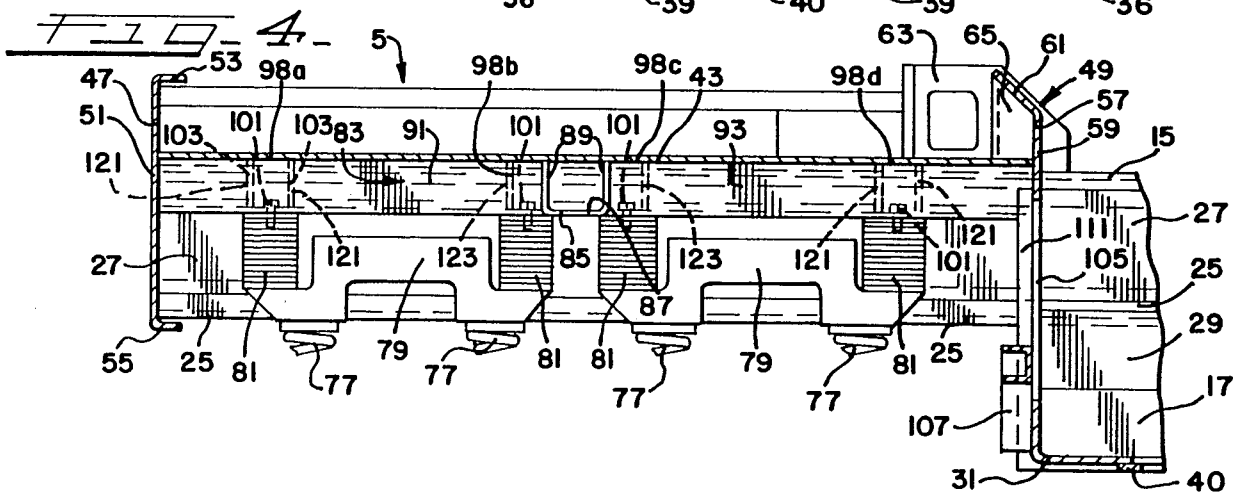
FIG. 4 is a section view taken along line 4—4 of FIG. 1 and showing the frameless radial truck mounting structure.
Figure 5:
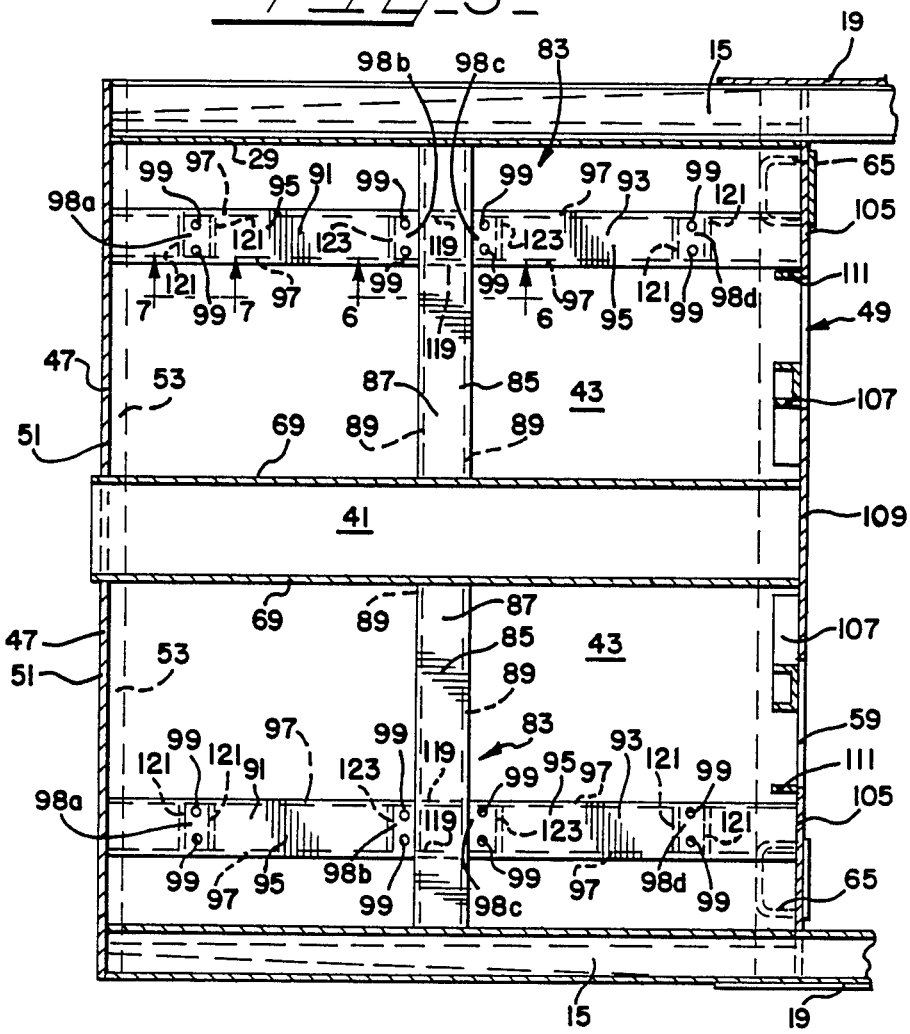
FIG. 5 is a view taken along line 5—5 of FIG. 3 and showing a bottom view of the end structure of the railway car shown in FIG. 1.

As is best visible in FIGS. 1, 2, and 4, each truck 8 comprises a pair of axles 71 each supporting a pair of wheels 73. Axles 71 are journalled into axle housings secured to lower castings 75. Spring structures 77 are supported on castings 75 and extend upwardly therefrom, springingly supporting upper castings 79 thereon. Upper castings 79 each have resilient support means thereon in the form of a pair of longitudinally spaced resilient elements 81.

Figure 6:
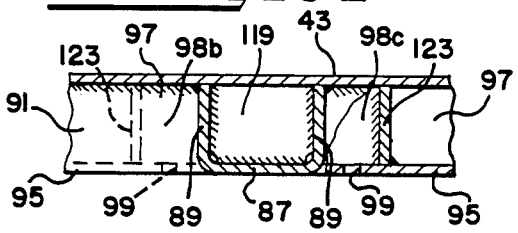
FIG. 6 is a section taken along line 6—6 of FIG. 5 with a portion of the structure cut away to show the reinforcement within the channel beams of the end structure.
Figure 7:
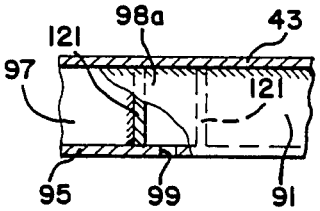
FIG. 7 is a section taken along line 7—7 of FIG. 5 with a portion of the structure cut away to show the reinforcement within the channel beams of the end structure.

End structure 5 engages resilient element 81 of truck 8 for supporting the weight of the car 3 thereon. To enable end structure 5 to transmit the full weight of the car 3 and its cargo to the resilient elements 81 of the truck 8, each end structure 5 is provided with reinforcement structures generally indicated at 83. Each reinforcement structure 83 comprises a transversely extending channel shaped cross support member 85 extending between channel member 15 and a respective wall 69 of center sill 41. Channel shaped cross support member 85 comprises a generally horizontal wall portion 87 and a pair of generally vertical wall portions 89 formed integral with the horizontal wall portion 87 and extending upwardly therefrom to attach to the undersurface of the shear plate member 43, as best shown in FIG. 6. The reinforcement structures 83 also include a first longitudinally extending truck support member or beam 91 extending between the end sill structure 47 and the transverse beam 85, and a second longitudinally extending truck support member or beam 93 extending between transversely extending beam 85 and deflection member 59. Both longitudinally extending beams 91 and 93 are channel shaped members having a horizontal wall portion 95 and a pair of vertical wall portions 97 formed integral therewith and extending upwardly therefrom to attach to the lower surface of shear plate member 43. The longitudinally extending beams 91 and 93 are provided with truck engagement structures **98*a*, 98*b*, 98*c*, and 98*d* each having receiving means in the form of openings 99 which are configured to receive pins 101 supported in resilient elements 81** and extending upwardly therefrom.

The loads transferred between the resilient elements 81 of the truck 8 and the end structure 5 may be applied in a variety of directions. The weight of the car is transferred as a vertical load to the resilient elements 81. During acceleration and deceleration of the car longitudinal loads are applied to the end structure as a result of drag of the truck 8. During cornering, the end structure 5 will have a tendency to slip laterally off the resilient elements 81, and this will result in lateral loads being applied to the reinforcement structures 83.

Vertical loads arising from the weight of the car and the weight of containers in the well section are transmitted to the end structures 5 through the side structures 9 and 11. The weight of the containers rests primarily on the floor support members 17. These loads are transmitted longitudinally to the ends of the well portion where floor support member 17 are fixedly connected to the end beams 31. The vertical loads are transferred upwardly from floor support members 17 to the end structure through the side structures 9 and 11, and through plates 105 and diagonal support members 107. Diagonal support members extend from the lateral end of end beam 31 upwardly and laterally inwardly of the car to connect to a middle portion of vertical wall 59 of deflection member 57. Center sill cover plate 109 is secured to the lower edge of vertical wall portion 59 and to the inward terminal end of center sill 41. Plate 109 provides additional surface area for welding the diagonal support members 107 to the girder structure 49 and tying the diagonal support members 107 structurally thereto.

Plates 105 extend upwardly from the lateral ends of end beam 31 and connect to the lower edge of vertical wall 59 of the girder structure 49. Plates 105 are provided with stiffening flanges 111 at the laterally inward edges thereof to protect the inward edge of the plates from being dented by contact with containers being loaded into the well of the car. Plates 105 flare upwardly from the connection to end beam 31. At the upward ends of the plates 105, a portion of the plate 105 is fixedly connected to the end of longitudinal support beam 93.

The vertical loads in the floor support member 17 are partially transferred through plate members 105 to the laterally inward ends of the longitudinally beams 93 and then to the resilient elements 81 of the truck 8. The vertical loads are also transferred upwardly through channel members 107 into the lateral center of girder structure 49 to the center sill 41. The vertical loads are transferred by end sill structure 47 laterally outwardly to longitudinal beams 91 and then to the resilient elements 81. The vertical loads in the center sill 41 are also transferred laterally outwardly therefrom by transverse beams 85 to longitudinal beams 91 and 93 and to the resilient elements 81. Vertical loads are also transferred up through the side structures 9 and 11 to be beamed laterally through girder structure 49, transverse beams 85, and end sill structure 47 into longitudinal beams 91 and 93.

Loads are beamed laterally inward and then beamed longitudinally from the transverse beam 85 into longitudinal beams 91 and 93 to the truck engagement structures **98*b* and 98*c*. This longitudinal relocation of the vertical load results in a moment applied at the connection of beams 91 and 93 to the walls 89 of transverse beam 85. Transverse beam 85 forms a torque tube structure with the shear plate member 43 and is able to support the torsional load over its length between the associated side structure 9 and 11 and the center sill 41. To enable transverse beam 85 to receive this load, internal reinforcement plates 119 are provided inside channel 85 engaging the walls 87 and 89 and shear plate member 43. Reinforcements 119 are substantially longitudinally aligned with the walls 97 of longitudinal beams 91 and 93. Walls 119 are fixedly attached as by welding to the walls 87 and 89 of channel transverse beam 85**.

Each of the truck engagement structures **98*a*, 98*b*, 98*c*, and 98*d*, are closed box structures for supporting horizontal loads applied at openings 99 in either lateral or longitudinal direction and beaming those into the torque box or torque tube structure formed by channel shaped members 91 and 93 secured to the lower surface of shear plate 43. Truck engagement structures 98*a* and 98*d* include internal reinforcement plates 121 secured between the walls 95 and 97 of the respective longitudinal beams 91 and 93. One plate 121 is supported to one longitudinal side of the openings 99 and another plate 121 is fixedly attached to the walls 95 and 97 of the beams 91 and 93 on the opposite longitudinal side of the openings 99. The resulting structure is a closed torque box structure for bearing both longitudinal and lateral loads in wall 95**.

Truck engagement structures **98*b* and 98*c* are also closed box structures. The box structures are formed by a reinforcement plate 123 fixedly attached as by welding to the inner faces of walls 95 and 97 of longitudinal beams 91 and 93 and by the attachment of the end of longitudinal beams 91 and 93 to the walls 89 of the transverse beam 85, as best shown in FIG. 6. Reinforcement plate 123 engages shear plate member 43 and the walls 95 and 97 of the respective longitudinal beam 91 and 93. The walls 95 and 97 of longitudinal beams 91 and 93 are fixedly secured as by welding to a respective wall 89 of the transverse beam 85 to form a torque box structure therewith for bearing longitudinal and lateral horizontal forces applied at openings 99**.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. A railway car train comprising:

a truck including a first transversely extending axle and having a first pair of wheels supported thereon whereby said truck is rollingly support on a pair of rails;

the truck having first and second transversely spaced pairs of longitudinally spaced support means for receiving vertical loads;

a car body having end structures supported on the support means of the truck;

each of said end structures including first and second transversely spaced generally longitudinally extending side structures;

a first generally transversely extending beam member fixedly connected with each of the side structures;

a center sill extending generally longitudinally and being supported between said side structures;

first and second cross support members positioned longitudinally inwardly of the first transversely extending beam member, each fixedly connected with the center sill and with said first and second side structures, respectively;

first and second truck support members each being fixedly connected with the first transversely extending beam member and the first and second cross support members respectively;

the truck support members each having a pair of longitudinally spaced truck engagement means thereon, engaging a respective pair of support means for supporting the car body on the truck;

said cross support members and said first transversely extending beam member receiving vertical loads from the side structures and transferring said loads to the associated truck support beams for supporting the end structure of the car on the truck;

one of each pair of truck engagement means on the respective truck support member being supported adjacent the first transversely extending beam member and the other of each pair of truck engagement means being supported adjacent the cross support member connected with the respective truck support member for receiving the vertical loads from the beam member and cross support members and transferring the loads to the support means of the truck for supporting the end structure of the railway car thereon, and generally horizontal plate means being fixedly connected with said side structures, the center sill, said beam member, said cross support members, and said truck support members to reinforce said members for support loads in the end structure.

2. The invention according to claim 1 and said plate means having a lower surface portion; and each of said truck support members comprising a pair of laterally spaced walls connected with the lower surface portion of the plate means and extending generally downwardly therefrom and a generally horizontally extending wall connected with the pair of laterally spaced walls and extending therebetween, the walls of each truck support member and the plate means forming a torque tube structure for bearing loads between the end structure and the support means of the truck.

3. A railway car train comprising:

a truck including a first transversely extending axle and having a first pair of wheels supported thereon whereby said truck is rollingly supported on a pair of rails;

the truck having first and second transversely spaced pairs of longitudinally spaced support means for receiving vertical loads;

a car body having end structures supported on the support means of the truck;

each of said end structures including first and second transversely spaced generally longitudinally extending side structures;

a first generally transversely extending beam member fixedly connected with each of the side structures;

a center sill extending generally longitudinally and being supported between said side structures;

a first and second cross support members positioned longitudinally inwardly of the first transversely extending beam member, each fixedly connected with the center sill and with said first and second side structures, respectively;

first and second truck support members each being fixedly connected with the first transversely extending beam member and the first and second cross support members respectively;

the truck support members each having a pair of longitudinally spaced truck engagement means thereon, engaging a respective pair of support means for supporting the car body on the truck;

said cross support members and said first transversely extending beam member receiving vertical loads from the side structures and transferring said loads to the associated truck support beams for supporting the end structure of the car on the truck;

one of each pair of truck engagement means on the respective truck support member being supported adjacent the first transversely extending beam member and the other of each pair of truck engagement means being supported adjacent the cross support member connected with the respective truck support member for receiving the vertical loads from the beam member and cross support members and transferring the loads to the support means of the truck for supporting the end structure of the railway car thereon;

a generally horizontal plate member fixedly connected with the side structures and said center sill;

said plate member having a lower surface portion; and each of said truck support members comprising a pair of laterally spaced walls connected with the lower surface portion of the plate member and extending generally downwardly therefrom and a generally horizontally extending wall connected with the pair of laterally spaced walls and extending therebetween, the walls of each truck support member and the plate member forming a torque tube structure for bearing loads between the end structure and the support means of the truck; and the first truck support member having a first reinforcement member therein adjacent one of the truck engagement means, said reinforcement member engaging the plate member and the walls of the first truck support member for reinforcing the first truck support member to transfer loads to the truck.

4. The invention according to claim 3 and a second reinforcement member connected with the first truck support member and engaging the plate member and the walls of the first truck support member;

truck engagement means engaging the first truck support member intermediate the locations of the first and second reinforcement members;

the truck support member, the plate member and the reinforcement members forming a closed box reinforcement structure for transferring transverse and longitudinal loads to the truck engagement means.

5. A railway car train comprising:

a truck including a first transversely extending axis and having a first pair of wheels supported thereon whereby said truck is rollingly supported on a pair of rails;

the truck having first and second transversely spaced pairs of longitudinally spaced support means for receiving vertical loads;

a car body having end structures supported on the support means of the truck;

each of said end structures including first and second transversely spaced generally longitudinally extending side structures;

a first generally transversely extending beam member fixedly connected with each of the side structures;

a center sill extending generally longitudinally and being supported between said side structures;

first and second cross support members positioned longitudinally inwardly of the first transversely extending beam member, each fixedly connected with the center sill and with said first and second side structures, respectively;

first and second truck support members each being fixedly connected with the first transversely extending beam member and the first and second cross support members respectively;

the truck support members each having a pair of longitudinally spaced truck engagement means thereon, engaging a respective pair of support means for supporting the car body on the truck;

said cross support members and said first transversely extending beam member receiving vertical loads from the side structures and transferring said loads to the associated truck support beams for supporting the end structure of the car on the truck;

one of each pair of truck engagement means on the respective truck support member being supported adjacent the first transversely extending beam member and the other of each pair of truck engagement means being supported adjacent the cross support member connected with the respective truck support member for receiving the vertical loads from the beam member and cross support members and transferring the loads to the support means of the truck for supporting the end structure of the railway car thereon;

a generally horizontal plate member fixedly connected with the side structures and said center sill;

said plate member having a lower surface portion; and each of said truck support members comprising a pair of laterally spaced walls connected with the lower surface portion of the plate member and extending generally downwardly therefrom and a generally horizontally extending wall connected with the pair of laterally spaced walls and extending therebetween, the walls of each truck support member and the plate member forming a torque tube structure for bearing loads between the end structure and the support means of the truck; and the generally horizontal wall of the first truck support members having aperture means therein receivingly engaging the truck engagement means.

6. The invention according to claim 3 and said center sill being a stub center sill; and said plate means acting as a shear plate for beaming longitudinal loads in the stub center sill laterally outward to the side sill members.

7. The invention according to claim 3 and said first reinforcement member being adjacent the first cross support member;

said first cross support member having a wall portion fixedly connected with the plate member and depending downwardly therefrom;

the walls of the first truck support member being fixedly engaged with the wall portion; and one of the truck engagement means engaging the first truck support member longitudinally intermediate the first reinforcement member and the wall portion of the first cross support member;

the wall of the first truck support member, the top plate member, the reinforcement member, and the wall portion of the first cross support member forming a box structure for transferring loads form the first cross support member to the truck engagement means.

8. A railway car train comprising:

a truck including a first transversely extending axle and having a first pair of wheels supported thereon whereby said truck is rollingly supported on a pair of rails;

the truck having first and second transversely spaced pairs of longitudinally spaced support means for receiving vertical loads;

a car body having end structures supported on the support means of the truck;

each of said end structures including first and second transversely spaced generally longitudinally extending side structures;

a first generally transversely extending beam member fixedly connected with each of the side structures;

a center sill extending generally longitudinally and being supported between said side structures;

first and second cross support members positioned longitudinally inwardly of the first transversely extending beam member, each fixedly connected with the center sill and with said first and second side structures, respectively;

first and second truck support members each being fixedly connected with the first transversely extending beam member and the first and second cross support members respectively;

the truck support members each having a pair of longitudinally spaced truck engagement means thereon, engaging a respective pair of support means for supporting the car body on the truck;

said cross support means and said first transversely extending beam member receiving vertical loads from the side structures and transferring said loads to the associated truck support beams for supporting the end structure of the car on the truck;

one of each pair of truck engagement means on the respective truck support member being supported adjacent the first transversely extending beam member and the other of each pair of truck engagement means being supported adjacent the cross support member connected with the respective truck support member therespective truck support member being supported adjacent the first transversely extending beam member and the other of each pair of truck engagement means being supported adjacent the support member connected with the respective truck support member for receiving the vertical loads from the beam member and cross support members and transferring the loads to the support means of the truck for supporting the end structure of the railway car thereon;

a generally horizontal plate member fixedly connected with the side structures and said center sill;

said plate member having a lower surface portion; and each of said truck support members comprising a pair of laterally spaced walls connected with the lower surface portion of the plate member and extending generally downwardly therefrom and a generally horizontally extending wall connected with the pair of laterally spaced walls and extending therebetween, the walls of each truck support member and the plate member forming a torque tube structure for bearing loads between the end structure and the support means of the truck;

said first cross support member having first and second longitudinally spaced transversely extending walls fixedly connected with the lower surface portion of the plate member and depending downwardly therefrom and a generally horizontal wall connected with the first and second walls of the cross support member;

said walls of the first truck support member being fixedly engaged with the first wall of the cross support member for transfer of loads therebetween.

9. The invention according to claim 8 and the first cross support member having a pair of transversely spaced reinforcement means therein engaging the walls thereof and the top plate member;

said pair of reinforcement means being substantially aligned longitudinally with the first and second walls respectively of first truck support member for efficient transfer of loads from the side sill member, through the first cross support member, and to the first truck support member.

10. A railway car train comprising:

a truck including a first transversely extending axle and having a first pair of wheels supported thereon whereby said truck is rollingly supported on a pair of rails;

the truck having first and second transversely spaced pairs of longitudinally spaced support means for receiving vertical loads;

a car body having end structures supported on the support means of the truck;

each of said end structures including first and second transversely spaced generally longitudinally extending side structures;

a first generally transversely extending beam member fixedly connected with each of the side structures;

a center sill extending generally longitudinally and being supported between said side structures;

first and second cross support members positioned longitudinally inwardly of the first transversely extending beam member, each fixedly connected with the center sill and with said first and second side structures, respectively;

first and second truck support members each being fixedly connected with the first transversely extending beam member and the first and second cross support members respectively;

the truck support members each having a pair of longitudinally spaced truck engagement means thereon, engaging a respective pair of support means for supporting the car body on the truck;

said cross support members and said first transversely extending beam member receiving vertical loads from the side structures and transferring said loads to the associated truck support beams for supporting the end structure of the car on the truck;

one of each pair of truck engagement means on the respective truck support member being supported adjacent the first transversely extending beam member and the other of each pair of truck engagement means being supported adjacent the cross support member connected with the respective truck support member for receiving the vertical loads from the beam member and cross support members and transferring the loads to the support means of the truck for supporting the end structure of the railway car thereon;

a generally horizontal plate member fixedly connected with the side structures and said center sill;

the car body including a well structure connected with the end structure, said well structure including a transversely extending well cross member supported below said first transverse beam member, and a first well support member fixedly connected with the first transverse beam member and extending downwardly therefrom, said well support member being connected to said well cross member for supporting the well structure;

said well support member being connected with the transverse beam member in a location substantially longitudinally aligned with the first truck support member whereby vertical loads in the well support member are efficiently beamed from the well cross member, through the first well support member to the first truck support member for support on the support means of the truck.

11. The invention according to claim 10 and said well structure including a generally longitudinally extending side support member being fixedly connected with the well cross member and being laterally outwardly positioned with respect to the first truck support member;

said side support member having cargo engaging means thereon for receiving vertical loads from cargo in the well structure;

said well support member being connected with the well cross member adjacent the side support member and extending upwardly and laterally inwardly therefrom to beam vertical loads in the side support member laterally inwardly to the first truck support member.

12. A railway car comprising:

a truck having first and second transversely extending longitudinally spaced axle assemblies each having a pair of wheels supported thereon whereby the truck is rollingly supported on a pair of rails;

a car body having an end structure supported on the truck;

said first axle assembly supporting first and second transversely spaced pairs of longitudinally spaced support means and said second axle assembly supporting third and fourth transversely spaced pairs of longitudinally spaced support means for supporting the end structure of the car body thereon;

the end structure of the car body including:

first and second transversely spaced generally longitudinally extending side structures;

first and second generally transversely extending beam members fixedly connected with the side structures and extending therebetween for receiving generally vertical loads therefrom;

a center sill extending generally longitudinally intermediate the side structures;

first and second cross support members each being fixedly connected with the center sill and a respective side structure and extending generally transversely with respect to the car for receiving generally vertical loads therefrom;

first and second truck support members each being fixedly connected with the first transverse beam member and with a respective cross support member;

third and fourth truck support members each being fixedly connected with the second transverse beam member and with a respective cross support member;

each of the truck support members having a pair of longitudinally spaced truck engagement means engaging a respective pair of support means on the truck for supporting the car body thereon;

one of each pair of truck engagement means being supported adjacent the cross support member connected with the associated truck support means and the other of each pair of truck engagement means being supported adjacent the transverse beam member connected with the associated truck support means for transmitting vertical loads received from the transverse beam members and the cross support members to the support means on the truck.

13. The invention according to claim 12 and, the first and second truck support members being substantially longitudinally aligned with the third and fourth truck support members to provide a structure for transmitting longitudinal loads from the transverse beam members to the support means on the truck.

14. The invention according to claim 12 and a generally horizontal plate member fixedly connected with the side structures.

15. The invention according to claim 14 and said plate member having a downward facing surface portion; and said cross support members and said truck support members being fixedly connected with said downward facing surface portion.

16. The invention according to claim 15 and said cross support members and said truck support members each comprising first and second spaced generally parallel downwardly depending walls connected with the downward facing surface portion and a generally horizontal wall connected with the first and second walls below said plate member.

17. The invention according to claim 16 and the first and second truck support members being generally longitudinally aligned with the third and fourth truck support members respectively.

18. The invention according to claim 17 and said cross support members each having a pair of laterally spaced reinforcement members therein engaging the first and second walls thereof.

19. The invention according to claim 17 and the first and second walls of the truck support members connected with each of the cross support members being substantially longitudinally aligned with the reinforcement members to reinforce the cross support members to receive loads from the truck support members.

* * * * *